US007277657B2

(12) United States Patent
Uchida et al.

(10) Patent No.: US 7,277,657 B2
(45) Date of Patent: Oct. 2, 2007

(54) CLEANING DEVICE AND IMAGE FORMING APPARATUS INCLUDING THE CLEANING DEVICE THAT CONTROLS OCCURRENCES OF BACKGROUND FOULING AND ABNORMAL IMAGE

(75) Inventors: Satoru Uchida, Tokyo (JP); Kiyoshi Horikawa, Kawasaki (JP); Hiroyoshi Haga, Kawaguchi (JP); Kazuchika Saeki, Iwatsuki (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 10/926,094

(22) Filed: Aug. 26, 2004

(65) Prior Publication Data

US 2005/0047816 A1 Mar. 3, 2005

(30) Foreign Application Priority Data

Aug. 26, 2003 (JP) ..... 2003-301439

(51) Int. Cl.
*G03G 15/16* (2006.01)

(52) U.S. Cl. ..... 399/101; 399/297

(58) Field of Classification Search ..... 399/101, 399/350–354, 345, 297, 302, 308
See application file for complete search history.

(56) References Cited

U.S. PATENT DOCUMENTS 4,694,332 A 9/1987 Uchida
4,786,821 A 11/1988 Uchida
4,806,775 A 2/1989 Uchida
5,029,840 A 7/1991 Haga et al.
5,396,319 A * 3/1995 Tokuhashi et al. ..... 399/351
5,483,330 A 1/1996 Ogiyama et al.
5,870,650 A 2/1999 Takahashi et al.
5,983,060 A 11/1999 Namekata et al.
5,991,570 A 11/1999 Haga et al.

(Continued)

FOREIGN PATENT DOCUMENTS

JP 3-58668 6/1991

(Continued)

OTHER PUBLICATIONS

U.S. Appl. No. 11/452,969, filed Jun. 15, 2006, Saeki et al.

(Continued)

*Primary Examiner*—David M. Gray
*Assistant Examiner*—Erika J. Villaluna
(74) *Attorney, Agent, or Firm*—Oblon, Spivak, McClelland, Maier & Neustadt, P.C.

(57) ABSTRACT

A cleaning device is used in an image forming apparatus to remove residual attachments including toner and paper powders from a surface of a movable intermediate transfer element onto which toner images are transferred from an image carrier. The cleaning device includes a cleaning brush that contacts the surface of the intermediate transfer element to apply a bias having a predetermined polarity to the toner adhered onto the surface of the intermediate transfer element so as to make uniform a polarity of the toner. The cleaning device further includes a pressing member that contacts the surface of the intermediate transfer element with a predetermined pressure. The pressing member is disposed at a position upstream of the cleaning brush in a direction of movement of the intermediate transfer element.

25 Claims, 5 Drawing Sheets

U.S. PATENT DOCUMENTS

| | | | | |
|---|---|---|---|---|
| 6,035,157 | A | 3/2000 | Takahashi et al. | |
| 6,167,230 | A | 12/2000 | Kimura et al. | |
| 6,275,671 | B1 * | 8/2001 | Hamada et al. | 399/101 |
| 6,311,031 | B1 * | 10/2001 | Hirano | 399/101 |
| 6,336,025 | B1 | 1/2002 | Saeki | |
| 6,487,387 | B2 * | 11/2002 | Kusaba et al. | 399/302 |
| 6,915,097 | B2 * | 7/2005 | Okamoto | 399/101 X |
| 2002/0009314 | A1 * | 1/2002 | Nakayama | 399/297 |
| 2004/0042821 | A1 * | 3/2004 | Onishi et al. | 399/127 |

FOREIGN PATENT DOCUMENTS

| | | | |
|---|---|---|---|
| JP | 05-323846 | | 12/1993 |
| JP | 2759813 | | 3/1998 |
| JP | 10268728 | A * | 10/1998 |

OTHER PUBLICATIONS

U.S. Appl. No. 11/471,599, filed Jun. 21, 2006, Saeki et al.
U.S. Appl. No. 11/377,568, filed Mar. 17, 2006, Katoh et al.
U.S. Appl. No. 11/279,193, filed Apr. 10, 2006, Saeki.
U.S. Appl. No. 11/588,340, filed Oct. 27, 2006, Saeki et al.
U.S. Appl. No. 11/608,008, filed Dec. 7, 2006, Katoh et al.

* cited by examiner

CLEANING DEVICE AND IMAGE FORMING APPARATUS INCLUDING THE CLEANING DEVICE THAT CONTROLS OCCURRENCES OF BACKGROUND FOULING AND ABNORMAL IMAGE

CROSS-REFERENCE TO RELATED APPLICATIONS

This application claims priority to Japanese Patent Application No. 2003-301439 filed in the Japanese Patent Office on Aug. 26, 2003, the entire contents of which is hereby incorporated herein by reference.

BACKGROUND OF THE INVENTION

1. Field of the Invention

The present invention relates to a cleaning device used for removing residual attachments from a surface of an intermediate transfer element onto which toner images are transferred from at least one image carrier. The invention also relates to an image forming apparatus including the cleaning device. The present invention further relates to a method of removing residual attachments from a surface of an intermediate transfer element.

2. Discussion of the Related Art

In the related art, there are two types of image forming apparatuses: a mono-color image forming apparatus, and a multi-color image forming apparatus. In a multi-color image forming apparatus, multi-color images are formed by two types of multi-color image forming methods, for example: (1) toner images of different colors are transferred from respective image carriers onto a transfer material while being each superimposed thereon, and (2) toner images of different colors are sequentially transferred from at least one image carrier onto an intermediate transfer element while being each superimposed thereon, and then a superimposed color toner image is transferred from the intermediate transfer element onto a transfer material.

In the case of using an intermediate transfer element, substances, such as toner, paper powders, or various types of additives, typically adhere onto a photoreceptor functioning as an image carrier or an intermediate transfer element after toner images are transferred therefrom. For example, if paper powders remain on an intermediate transfer element, a surface of a photoreceptor that contacts the intermediate transfer element may be damaged by the residual paper powders. As a result, background fouling typically occurs on the resultant images due to bad cleaning of the photoreceptor.

Some devices use a cleaning blade that contacts a surface of a photoreceptor or an intermediate transfer element to remove residual attachments remaining on the surface of the photoreceptor or the intermediate transfer element. For example, Japanese Utility Model Publication No 3-58668 and published Japanese patent application No. 5-323846 each describe a cleaning device including a cleaning blade that contacts a surface of a photoreceptor, and an elastic plate. An edge portion of the elastic plate periodically slides on an edge portion of the cleaning blade to remove attachments accumulated on the edge portion of the cleaning blade.

Japanese patent No. 2759813 describes a cleaning device including a cleaning blade that contacts a surface of a photoreceptor, and a rotary brush member that contacts an edge portion of the cleaning blade to remove attachments accumulated on the edge portion of the cleaning blade.

Moreover, in some conventional systems, the polarity of residual toner remaining on a surface of a photoreceptor or an intermediate transfer element is uniformed by using a cleaning brush to enhance a removability of the residual toner. By doing so, an electrostatic transfer efficiency of toner may be enhanced in a subsequent cleaning process.

It is known that if a bias having a predetermined polarity is applied to the residual attachments on the intermediate transfer element by using a cleaning brush, the removability of residual toner may be enhanced, but the removability of the residual attachments other than toner, such as paper powders, may be unchanged. If such attachments remain on the intermediate transfer element and if the linear velocity of the intermediate transfer element is different from that of a photoreceptor, a surface of the photoreceptor is rubbed against the attachments remaining on the intermediate transfer element, and is damaged.

If the surface of the photoreceptor is damaged, a cleaning device may not effectively clean the damaged surface of the photoreceptor, thereby causing background fouling on the resultant images due to bad cleaning of the photoreceptor. If residual attachments are removed from a photoreceptor by contacting a leading edge portion of a cleaning blade to the surface of the photoreceptor, toner blocked by the cleaning blade accumulates on the leading edge portion of the cleaning blade. When an impacting force is applied to the accumulated toner, the accumulated toner easily falls from the leading edge portion of the cleaning blade by gravity, and may fall on an image carried on an intermediate transfer element. As a result, an abnormal image typically occurs due to mixture of the fallen toner and the image carried on the intermediate transfer element.

In some conventional systems, a releasing agent is applied onto a surface of a photoreceptor or an intermediate transfer element to prevent foreign substances from adhering onto the surface thereof by decreasing a coefficient of friction of the surface thereof. However, it may be difficult to uniform a coefficient of friction of a surface of a photoreceptor or an intermediate transfer element in a short period of time, and the coefficient of friction of the surface thereof may change with time. Considering the cost consumed for providing a releasing agent application device, a desired advantage may not be obtained.

Therefore, as discovered by the present inventors, it is desirable to provide a cleaning device and an image forming apparatus including the cleaning device that can exert a good cleaning performance on residual attachments on an intermediate transfer element and can control occurrences of background fouling and an abnormal image.

Further, it is desirable to provide a method of removing residual attachments from a surface of an intermediate transfer element while exerting a good cleaning performance on residual attachments on an intermediate transfer element and while controlling occurrences of background fouling and an abnormal image.

SUMMARY OF THE INVENTION

According to an aspect of the present invention, a cleaning device is used in an image forming apparatus to remove residual attachments including toner from a surface of a movable intermediate transfer element onto which toner images are transferred from at least one image carrier. The cleaning device includes a cleaning brush configured to contact the surface of the intermediate transfer element and to apply a bias having a predetermined polarity to the toner adhered onto the surface of the intermediate transfer element so as to make uniform a polarity of the toner, and a pressing member configured to contact the surface of the intermediate transfer element with a predetermined pressure. The pressing member is disposed at a position upstream of the cleaning brush in a direction of movement of the intermediate transfer element.

The pressing member may be formed from a blade member, and the blade member may contact the surface of the intermediate transfer element such that an area of a surface of the blade member contacts the surface of the intermediate transfer element with a predetermined contact width. The surface of the blade member extends from a leading edge of the blade member located on a forward side in the direction of movement of the intermediate transfer element.

The pressing member may be configured to contact and separate from the surface of the intermediate transfer element in a period other than at least an image forming period of the image forming apparatus.

The pressing member may be configured to contact and separate from the surface of the intermediate transfer element in a period in which the intermediate transfer element does not carry a toner image transferred from the at least one image carrier.

The residual attachments may further include paper powders, and the cleaning brush may be configured to scrape the paper powders off the surface of the intermediate transfer element after the paper powders pass through a contact part between the pressing member and the surface of the intermediate transfer element.

According to another aspect of the present invention, an image forming apparatus includes at least one image carrier configured to carry a toner image on a surface of the at least one image carrier, an intermediate transfer element configured to move and to receive the toner image from the surface of the at least one image carrier, a transfer device configured to transfer the toner image from the intermediate transfer element to a transfer material, and the above-described cleaning device.

According to yet another aspect of the present invention, a method of removing residual attachments including toner from a surface of an intermediate transfer element includes steps of contacting a pressing member to the surface of the intermediate transfer element with a predetermined pressure, moving the surface of the intermediate transfer element, passing the residual attachments through a contact part between the pressing member and the surface of the intermediate transfer element, applying a bias having a predetermined polarity to the toner adhered on the surface of the intermediate transfer element, and transferring the toner having the predetermined polarity from the surface of the intermediate transfer element to at least one image carrier by applying a transfer bias having a polarity equal to the predetermined polarity of the toner to the toner.

The contacting step may include contacting the pressing member to the surface of the intermediate transfer element such that an area of a surface of the pressing member, which extends from a leading edge of the pressing member located on a forward side in the direction of movement of the intermediate transfer element, contacts the surface of the intermediate transfer element with a predetermined contact width.

The method may further include a step of contacting and separating the pressing member to and from the surface of the intermediate transfer element in a period other than at least an image forming period.

The method may further include a step of contacting and separating the pressing member to and from the surface of the intermediate transfer element in a period in which the intermediate transfer element does not carry a toner image transferred from the at least one image carrier.

The residual attachments may further include paper powders, and the method may further include step of separating the paper powders from the surface of the intermediate transfer element while passing the paper powders through the contact part between the pressing member and the surface of the intermediate transfer element, and scraping the paper powders off the surface of the intermediate transfer element.

BRIEF DESCRIPTION OF THE DRAWINGS

A more complete appreciation of the present invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
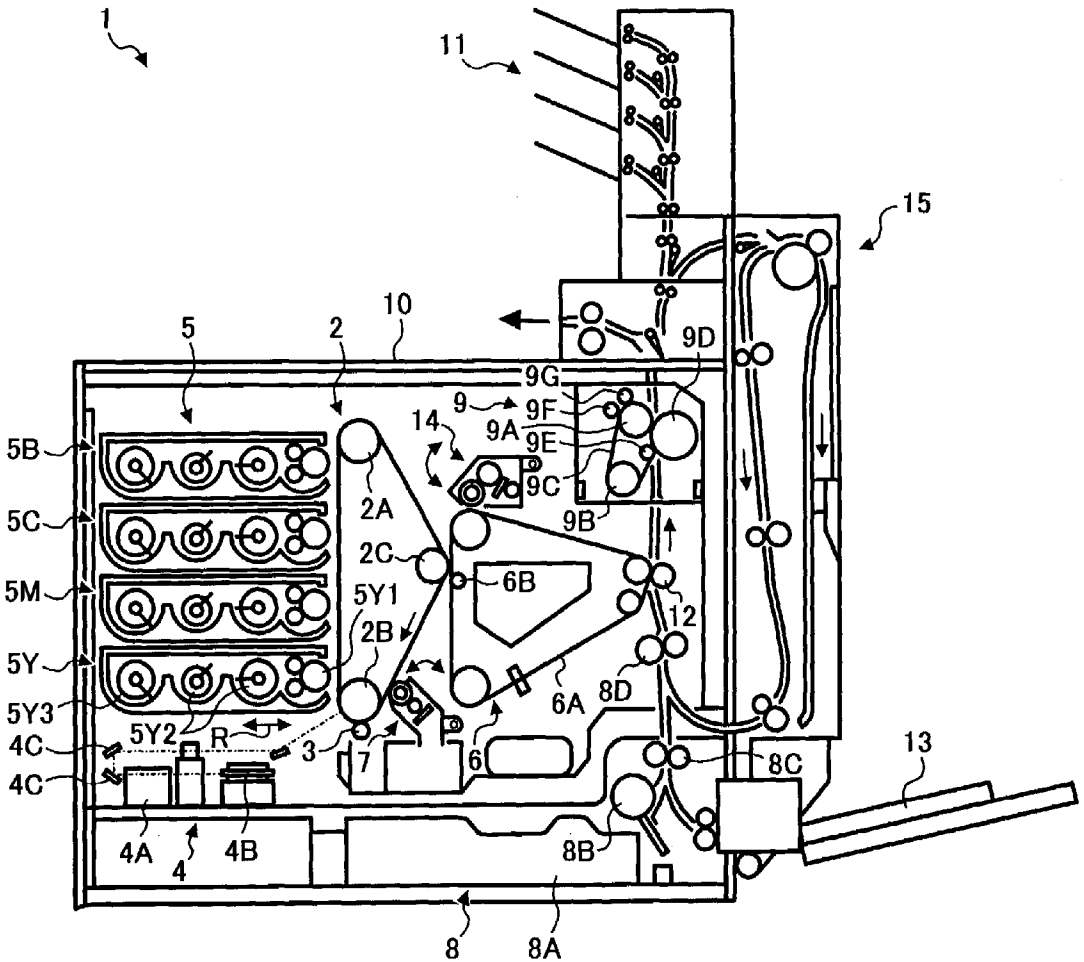
FIG. 1 is a schematic view of an image forming apparatus including a cleaning device according to an embodiment of the present invention.

Preferred embodiments of the present invention are described in detail referring to the drawings, wherein like reference numerals designate identical or corresponding parts throughout the several views.

FIG. 1 is a schematic view of an image forming apparatus including a cleaning device according to an embodiment of the present invention. As a non-limiting example, the image forming apparatus shown in FIG. 1 is a color printer that forms multi-color images.

A color printer 1 of FIG. 1 includes a belt-shaped image carrier, such as a photoreceptor 2. The photoreceptor 2 is spanned around a plurality of rollers, for example, three rollers 2A, 2B, and 2C, and is rotated in the direction indicated by the arrow in FIG. 1. Arranged around the photoreceptor 2 are a charging device 3, a laser writing device 4, a developing device 5, a primary transfer device 6, and a photoreceptor cleaning device 7, all of which are used for performing an image forming process while rotating the photoreceptor 2 in the color printer 2.

The laser writing device 4 includes a laser light source, such as a semiconductor laser 4A, a polygon mirror 4B, and reflection mirrors 4C for forming a light path. After the charging device 3 uniformly charges the surface of the photoreceptor 2, the semiconductor laser 4A emits laser beams in accordance with image data in a main-scanning direction and a sub-scanning direction with respect to the photoreceptor 2, thereby forming electrostatic latent images corresponding to the image data on the photoreceptor 2.

The developing device 5 develops the electrostatic latent images on the photoreceptor 2 with color toner in the relation of complementary colors of separated colors, and forms color toner images. Accordingly, the developing device 5 includes developing units 5Y, 5M, and 5C that accommodate yellow toner, magenta toner, and cyan toner in the relation of complementary colors of separated colors, respectively. The developing device 5 further includes a developing unit 5B that accommodates black toner used for forming a black and white image and for adjusting gray-scale.

The configurations of the developing units 5Y, 5M, 5C, and 5B are substantially the same except for the color of their toner. For this reason, only the configuration and operation of the developing unit 5Y will be described hereinafter.

The developing unit 5Y includes a developing sleeve 5Y1, developer supplying paddles 5Y2, and a toner cartridge 5Y3 as main elements. The developing sleeve 5Y1 supplies yellow toner to an electrostatic latent image formed on the photoreceptor 2. The developer supplying paddles 5Y2 convey developer including yellow toner while agitating for charging the yellow toner, and supply the charged yellow toner to the developing sleeve 5Y1. The toner cartridge 5Y3 replenishes the developing unit 5Y with fresh yellow toner. Each of the developing units 5Y, 5M, 5C, and 5B is configured to reciprocate in the direction indicated by double-headed arrow R in FIG. 1. That is, each of the developing units 5Y, 5M, 5C, and 5B is configured to be brought into contact with and separated from an outer (i.e., a front) surface of the photoreceptor 2. When developing an electrostatic latent image formed on the photoreceptor 2 with color toner, each of the developing units 5Y, 5M, 5C, and 5B approaches the photoreceptor 2, and each of the developing sleeves supplies color toner to the electrostatic latent image.

The photoreceptor cleaning device 7 is configured to remove residual toner from the surface of the photoreceptor 2.

Figure 2:
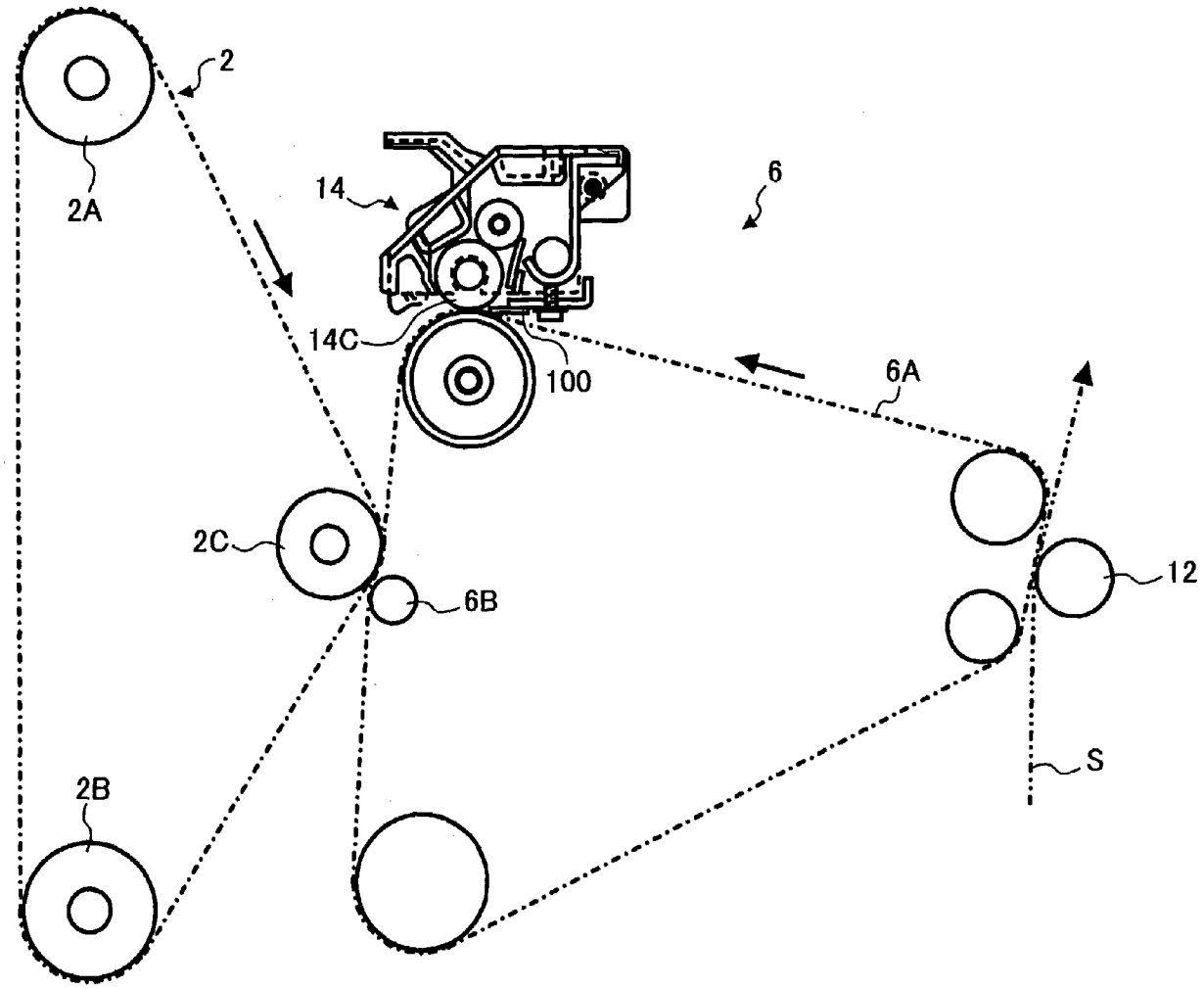
FIG. 2 is an enlarged view of a photoreceptor, a primary transfer device, a secondary transfer bias roller, and a belt cleaning device according to an embodiment of the present invention.

FIG. 2 is an enlarged view of the photoreceptor 2, the primary transfer device 6, a secondary transfer bias roller 12, and a belt cleaning device 14.

The primary transfer device 6 includes an intermediate transfer element, such as an endless intermediate transfer belt 6A that is spanned around a plurality of rollers and moves in the direction indicated by the arrow in FIG. 2. The intermediate transfer belt 6A moves in the same direction as a moving direction of the photoreceptor 2 at a position where the intermediate transfer belt 6A faces the photoreceptor 2. The intermediate transfer belt 6A contacts a part of the photoreceptor 2 which is wrapped around a part of an outer circumference of the roller 2C, thereby forming a primary transfer nip part. The primary transfer device 6 further includes a primary transfer bias roller 6B provided in contact with an inner (i.e., a rear) surface of the intermediate transfer belt 6A at a position adjacent to the primary transfer nip part. A primary transfer bias is applied to the primary transfer bias roller 6B from a power supply (not shown). At the primary transfer nip part, a primary transfer electric field is formed between the photoreceptor 2 and the primary transfer bias roller 6B under the influence of the primary transfer bias.

When forming a mono-color image, a mono-color toner image formed on the photoreceptor 2 is primarily transferred onto the intermediate transfer belt 6A under the influence of the primary transfer electric field. Then, the mono-color toner image is secondarily transferred from the intermediate transfer belt 6A onto a transfer material, such as a sheet S which is fed from a sheet feeding device 8 (shown in FIG. 1), at a secondary transfer nip part formed between the intermediate transfer belt 6A and the secondary transfer bias roller 12. A secondary transfer bias is applied to the secondary transfer bias roller 12 from a power supply (not shown), thereby forming a secondary transfer electric field at the secondary transfer nip part.

When forming a multi-color image, a yellow toner image formed on the photoreceptor 2 is primarily transferred onto the intermediate transfer belt 6A under the influence of the primary transfer electric field. Then, a magenta toner image, a cyan toner image, and a black toner image each formed on the photoreceptor 2 are sequentially transferred onto the intermediate transfer belt 6A and are each superimposed on the yellow toner image. As a result, a superimposed four-color toner image is formed on the intermediate transfer belt 6A. The superimposed four-color toner image on the intermediate transfer belt 6A is secondarily transferred onto a sheet S fed from the sheet feeding device 8 at the secondary transfer nip part under the influence of the secondary transfer electric field.

The sheet feeding device 8 shown in FIG. 1 includes a sheet feeding cassette 8A, a sheet feeding roller 8B, a pair of sheet conveying rollers 8C, and a pair of registration rollers 8D. The sheet feeding cassette 8A accommodates a stack of sheets S. The sheet feeding roller 8B presses against the uppermost sheet S. When the sheet feeding roller 8B is driven to rotate at a predetermined timing, the uppermost sheet S is fed out from the sheet feeding cassette 8A and is conveyed by the sheet conveying rollers 8C toward a nip part between the registration rollers 8D. The color printer 1 further includes a manual sheet feeding tray 13 that feeds a sheet S of different size and/or material from that of the sheets S accommodated in the sheet feeding cassette 8A. The sheet S fed out from the manual sheet feeding tray 13 by a sheet feeding roller (not shown) is conveyed to the nip part between the registration rollers 8D. The registration rollers 8D feed out the sheet S toward the secondary transfer nip part at a timing such that the sheet S contacts the mono-color toner image or the superimposed four-color toner image on the intermediate transfer belt 6A at the secondary transfer nip part.

The sheet S having a transferred toner image is fixed by a fixing device 9 shown in FIG. 1. The fixing device 9 includes a fixing roller 9A, a heat roller 9B, a fixing belt 9C, a pressure roller 9D, an auxiliary roller 9E, an offset preventing agent applying unit 9F, and a cleaning unit 9G. The fixing belt 9C is spanned around the fixing roller 9A and the heat roller 9B. The fixing roller 9A and the heat roller 9B have heat sources, respectively. The pressure roller 9D contacts the fixing roller 9A via the fixing belt 9C. The auxiliary roller 9E contacts a part of the extended surface of the fixing belt 9C. The offset preventing agent applying unit 9F applies offset preventing agents onto the surface of the fixing belt 9C to prevent an offset condition in which a part of a fused toner image adheres to the fixing belt 9C. The cleaning unit 9G removes the offset preventing agents from the surface of the fixing belt 9C. The toner image is fixed onto the surface of the sheet S while the sheet S passes through a nip part between the fixing belt 9C and the pressure roller 9D. The sheet S having passed through the fixing device 9 is discharged to a sheet discharging tray 10 or a sorter 11. When forming images on both sides of the sheet S, the sheet S having an image on its one side is reversed in a reverse unit 15 and is conveyed again to the registration rollers 8D.

Figure 3:
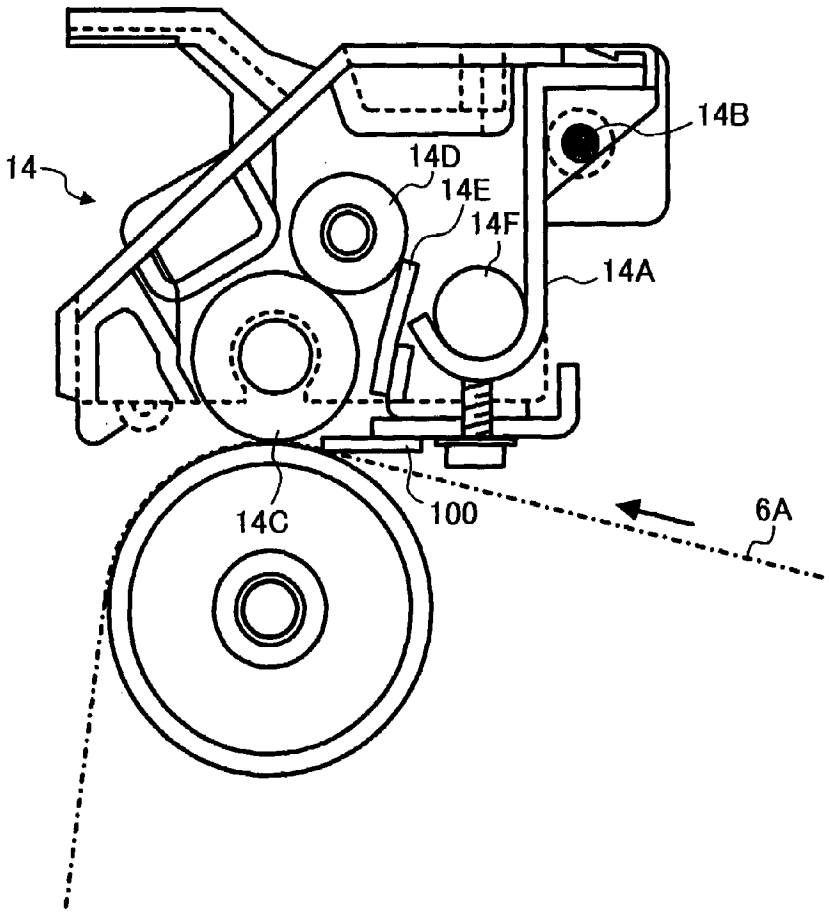
FIG. 3 is a schematic view of the belt cleaning device according to an embodiment of the present invention.

FIG. 3 is a schematic view of a belt cleaning device according to an embodiment of the present invention. After a toner image on the intermediate transfer belt 6A is secondarily transferred onto a sheet S, a belt cleaning device 14 is used for removing residual attachments, such as toner, and paper powders, from the surface of the intermediate transfer belt 6A. The belt cleaning device 14 includes a housing 14A configured to swing around a support shaft 14B.

Provided in the housing 14A are a cleaning brush 14C, a bias applying roller 14D, a foreign substance collecting blade 14E, and a toner collecting screw 14F.

The cleaning brush 14C contacts the intermediate transfer belt 6A at a position upstream of the primary transfer nip part formed between the photoreceptor 2 and the intermediate transfer belt 6A in the direction of movement of the intermediate transfer belt 6A and at a swing end side of the housing 14A. The bias applying roller 14D applies a bias having a predetermined polarity to the cleaning brush 14C. As a non-limiting example, in the present embodiment, the bias applying roller 14D applies a bias having a positive polarity to the cleaning brush 14C. Then, the cleaning brush 14C rotates and applies a bias having a positive polarity to residual toner adhered on the surface of the intermediate transfer element 6A to uniform a polarity of the residual toner. The leading edge of the foreign substance collecting blade 14E contacts the bias applying roller 14D to collect foreign substances, such as toner, and paper powders, which are adhered onto the surface of the bias applying roller 14D. The toner collecting screw 14F conveys the toner collected by the foreign substance collecting blade 14E to a container (not shown) or the developing device 5 for reuse.

The belt cleaning device 14 further includes a pressing member 100 disposed at a position upstream of the cleaning brush 14C in the direction of movement of the intermediate transfer belt 6A. The pressing member 100 has flexibility or elasticity, and is formed from a blade member. The coefficient of friction of the surface of the blade member is set to be equal to or less than that of the surface of the intermediate transfer belt 6A.

As described above, the housing 14A of the belt cleaning device 14 is configured to swing around the support shaft 14B in a period other than an image forming period. The term "image forming period" here means a period from when a latent image is formed on the photoreceptor 2 to when a toner image is transferred from the intermediate transfer belt 6A onto a sheet S. The pressing member 100 provided with the housing 14A swings according to the swing motion of the housing 14A, thereby contacting and separating from the surface of the intermediate transfer belt 6A in a period other than an image forming period. That is, the pressing member 100 is configured to contact and separate from the surface of the intermediate transfer belt 6A when the intermediate transfer belt 6A does not carry an image thereon. In an image forming period, the housing 14A is maintained such that the cleaning brush 14C and the pressing member 100 are separated from the intermediate transfer belt 6A. In a cleaning process period performed by the belt cleaning device 14 for the intermediate transfer belt 6A, the cleaning brush 14C and the pressing member 100 are brought into contact with the surface of the intermediate transfer belt 6A with a predetermined pressure. Thereby, the surface of the intermediate transfer belt 6A, from which a toner image has been secondarily transferred onto the sheet S, contacts the pressing member 100 at the position upstream of the primary transfer nip part and the cleaning brush 14C in the direction of movement of the intermediate transfer belt 6A.

Figure 4A:
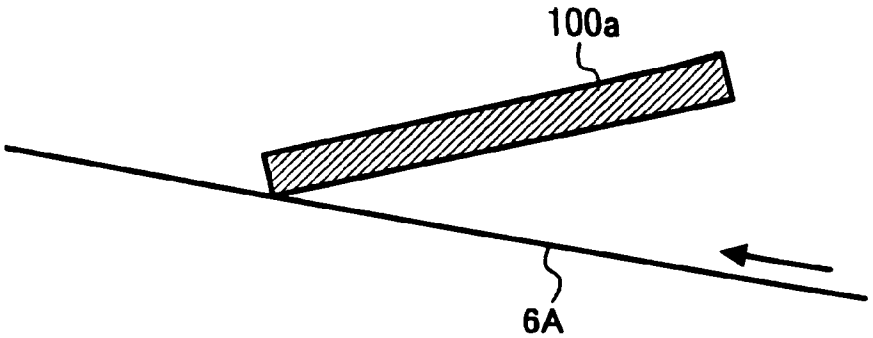
FIG. 4A BACKGROUND ART
FIGS. 4A and 4B are schematic views for explaining a contact condition of a pressing member relative to an intermediate transfer belt.
Figure 4B:
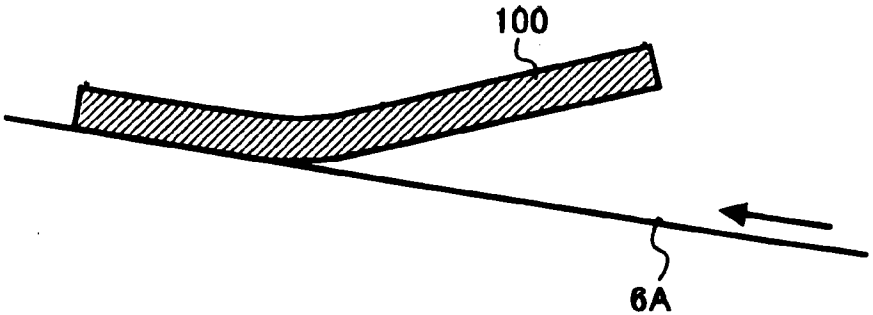

FIGS. 4A and 4B are schematic views for explaining a contact condition of a pressing member relative to the intermediate transfer belt 6A. FIG. 4A shows a background pressing member 100*a*, and FIG. 4B shows the pressing member 100 of the present embodiment. As illustrated in FIG. 4A, the background pressing member 100*a* contacts the surface of the intermediate transfer belt 6A such that only the leading edge of the pressing member 100*a* located on the forward side in the direction of movement of the intermediate transfer belt 6A contacts the surface of the intermediate transfer belt 6A. In other words, the pressing member 100*a* contacts the surface of the intermediate transfer belt 6A in a point contact state. On the other hand, as illustrated in FIG. 4B, in the present embodiment, the pressing member 100 contacts the surface of the intermediate transfer belt 6A such that an area of the surface of the pressing member 100, which extends from its leading edge located on the forward side in the direction of movement of the intermediate transfer belt 6A, contacts the surface of the intermediate transfer belt 6A with a predetermined contact width. In other words, the pressing member 100 contacts the surface of the intermediate transfer belt 6A in an area contact state. As compared to the background pressing member 100*a* in point contact with the surface of the intermediate transfer belt 6A, the pressing member 100 contacts the surface of the intermediate transfer belt 6A with less contact pressure per a unit area.

Specifically, the pressing member 100 is configured to contact the surface of the intermediate transfer belt 6A with a predetermined pressure that allows residual attachments, such as toner, and paper powders, which are carried on the intermediate transfer belt 6A to pass through a contact part between the pressing member 100 and the surface of the intermediate transfer belt 6A by movement of the surface of the intermediate transfer belt 6A. After a toner image is secondarily transferred from the intermediate transfer belt 6A onto the sheet S at the secondary transfer nip part formed between the intermediate transfer belt 6A and the secondary transfer bias roller 12, residual attachments including toner and paper powders on the surface of the intermediate transfer belt 6A are moved to the pressing member 100.

The paper powders adhered onto the intermediate transfer belt 6A tend to rise and separate from the surface of the intermediate transfer belt 6A by the action of the pressing force of the pressing member 100 that contacts the surface of the intermediate transfer belt 6A with a predetermined pressure and by the action of the repulsive force of the intermediate transfer belt 6A against the pressing force of the pressing member 100. The present inventors examined the condition of the paper powders adhered onto the intermediate transfer belt 6A under a microscope. According to the examination, before passing through the contact part between the pressing member 100 and the surface of the intermediate transfer belt 6A, the paper powders stuck into the surface of the intermediate transfer belt 6A. Further, the inventors saw dents in the surface of the intermediate transfer belt 6A after the surface thereof had passed through the contact part between the pressing member 100 and the surface of the intermediate transfer belt 6A where the paper powders were supposed to exist. Based on the examination, it is found that the paper powders adhered onto the intermediate transfer belt 6A floated up and separated from the surface of the intermediate transfer belt 6A while passing through the contact part between the pressing member 100 and the surface of the intermediate transfer belt 6A. The paper powders which float up and separate from the surface of the intermediate transfer belt 6A are easily removed from the surface of the intermediate transfer belt 6A by the cleaning brush 14C. If the paper powders stuck into the surface of the intermediate transfer belt 6A are moved to the primary transfer nip part formed between the photoreceptor 2 and the intermediate transfer belt 6A, the surface of the photoreceptor 2 is typically rubbed against the paper powders and is damaged. As a result, background fouling typically occurs on the resultant images due to bad cleaning of the photoreceptor 2. In the present embodiment, the surface of the photoreceptor 2 is prevented from being damaged by paper powders because the paper powders stuck into the surface of the intermediate transfer belt 6A are not moved to the primary transfer nip part.

Accordingly, the useful lifetime of the photoreceptor 2 can be extended, and image deterioration, such as background fouling, which is caused by bad cleaning of the photoreceptor 2 can be minimized or avoided. Next, a description will be made of the residual toner adhered onto the surface of the intermediate transfer belt 6A. After the toner passes through the contact part between the pressing member 100 and the surface of the intermediate transfer belt 6A by movement of the surface of the intermediate transfer belt 6A, the cleaning brush 14C applies a bias having a predetermined polarity (e.g., a positive polarity) to the toner to uniform the polarity of the toner. Subsequently, when the toner charged with the predetermined polarity (e.g., a positive polarity) is moved to the primary transfer nip part, the primary transfer bias roller 6B applies a bias having the same polarity as that of the charged toner (e.g., a positive polarity) to the toner adhered onto the intermediate transfer belt 6A. As a result, the toner is transferred from the intermediate transfer belt 6A onto the surface of the photoreceptor 2. Then, the toner is removed from the surface of the photoreceptor 2 by the cleaning device 7.

Figure 5:
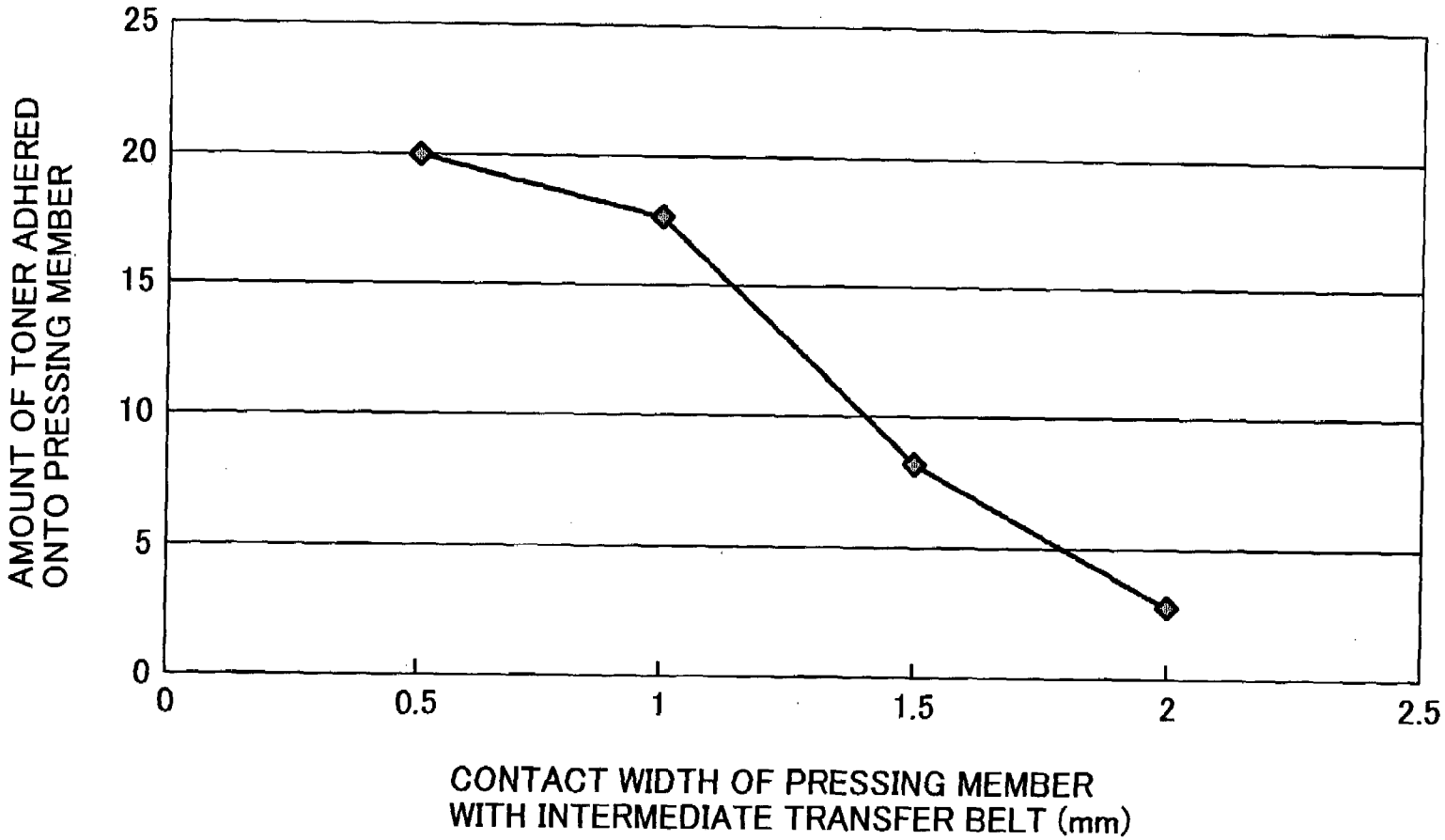
FIG. 5 is a graph showing a relationship between an amount of toner adhered onto a surface of the pressing member and a contact width of the pressing member with the intermediate transfer belt based on experimental results.

Experiments were conducted to examine a relationship between a contact width of the pressing member 100 with the surface of the intermediate transfer belt 6A and an amount of toner adhered onto the surface of the pressing member 100. FIG. 5 is a graph showing a relationship between an amount of toner adhered onto the surface of the pressing member 100 and a contact width of the pressing member 100 with the intermediate transfer belt 6A based on experimental results. As seen from the graph of FIG. 5, the amount of toner adhered onto the surface of the pressing member 100 decreases as the increase of the width of an area of the surface of the pressing member 100 which extends from its leading edge that contacts the surface of the intermediate transfer belt 6A.

If the pressing member 100 is in point contact with the surface of the intermediate transfer belt 6A and scrapes toner off the intermediate transfer belt 6A by its leading edge like the pressing member 100*a* shown in FIG. 4A, the toner on the intermediate transfer belt 6A may intensively accumulate on the leading edge of the pressing member 100, and may tend to remove and fall from the leading edge of the pressing member 100. If the pressing member 100 contacts the surface of the intermediate transfer belt 6A in an area contact state as shown in FIG. 4B with a predetermined pressure, the toner adhered onto the surface of the intermediate transfer belt 6A passes through the contact part between the pressing member 100 and the surface of the intermediate transfer belt 6A by movement of the surface of the intermediate transfer belt 6A as described above. Accordingly, the adhesion and accumulation of the toner onto the surface of the pressing member 100 is minimized or avoided. If accumulated toner falls from the pressing member 100 by gravity on an image carried on the intermediate transfer belt 6A, an abnormal image due to color change caused by mixture of the fallen toner and the image carried on the intermediate transfer belt 6A, and a background fouling typically occur. However, in the above-described embodiment of the present invention, image deterioration can be minimized or avoided by preventing the adhesion and accumulation of toner onto the surface of the pressing member 100 by passing toner adhered onto the surface of the intermediate transfer belt 6A through the contact part between the pressing member 100 and the surface of the intermediate transfer belt 6A.

However, if a large amount of toner images are printed and if a large amount of toner adheres onto the surface of the intermediate transfer belt 6A after toner images have been secondarily transferred onto the sheet S at the secondary transfer nip part, the toner may attach and accumulate on the surface of the pressing member 100 while the large amount of toner passes through the contact part between the pressing member 100 and the surface of the intermediate transfer belt 6A by movement of the surface of the intermediate transfer belt 6A. In this case, in a period other than an image forming period, the pressing member 100 is brought into contact with and separated from the surface of the intermediate transfer belt 6A to exert an inertial force on the toner adhered and accumulated on the surface of the pressing member 100. By doing so, the accumulated toner is forcibly fallen from the pressing member 100 onto the surface of the intermediate transfer belt 6A. Subsequently, the cleaning brush 14C applies a bias having a predetermined polarity (e.g., a positive polarity) to the toner adhered onto the intermediate transfer belt 6A to uniform the polarity of the toner. Subsequently, when the toner charged with the predetermined polarity (e.g., a positive polarity) is moved to the primary transfer nip part, the primary transfer bias roller 6B applies a bias having the same polarity as that of the charged toner (e.g., a positive polarity) to the toner adhered onto the intermediate transfer belt 6A. As a result, the toner is transferred from the intermediate transfer belt 6A onto the surface of the photoreceptor 2. Then, the toner is removed from the surface of the photoreceptor 2 by the cleaning device 7. By forcibly causing the toner adhered and accumulated on the surface of the pressing member 100 to fall onto the surface of the intermediate transfer belt 6A and by transferring the toner fallen onto the surface of the intermediate transfer belt 6A to the surface of the photoreceptor 2, an occurrence of an abnormal image due to mixture of fallen toner and an image carried on the intermediate transfer belt 6A can be obviated.

As a non-limiting example of the period other than at least an image forming period in which the pressing member 100 is brought into contact with and separated from the surface of the intermediate transfer belt 6A, the pressing member 100 is brought into contact with and separated from the surface of the intermediate transfer belt 6A at the end of image forming jobs or process control operations performed in the color printer 1. The process control operations are performed in the color printer 1 to check various conditions of the color printer 1 and adjust the conditions to initially set values. For example, the density of toner in the developing device 5 is detected and adjusted to an initially set toner density value. It is important that the period other than at least an image forming period in which the pressing member 100 is brought into contact with and separated from the surface of the intermediate transfer belt 6A should be one in which the toner collected by the pressing member 100 cannot be mixed with an image carried on the surface of the intermediate transfer belt 6A.

In the color printer 1 according to the embodiment of the present invention, an independent configuration need not be provided to prevent the toner adhered and accumulated on the surface of the pressing member 100 from being mixed with an image carried on the surface of the intermediate transfer belt 6A. As described above, the toner adhered and accumulated on the surface of the pressing member 100 can be prevented from being mixed with an image carried on the surface of the intermediate transfer belt 6A by contacting and separating the pressing member 100 to and from the surface of the intermediate transfer belt 6A to exert an inertial force on the toner adhered and accumulated on the surface of the pressing member 100. Thus, a high quality image can be obtained while controlling occurrences of an abnormal image and background fouling without increasing the cost of the apparatus.

The present invention has been described with respect to the exemplary embodiments illustrated in the figures. However, the present invention is not limited to these embodiments and may be practiced otherwise.

The present invention has been described with respect to a color printer as an example of an image forming apparatus. However, the present invention may be applied to other image forming apparatuses, such as a copying machine, a facsimile machine, etc. or a multi-functional image forming apparatus.

Further, in place of an image forming apparatus including one photoreceptor on which toner images of different colors are sequentially formed, the present invention may be applied to a tandem-type image forming apparatus including a plurality of photoreceptors.

Numerous additional modifications and variations of the present invention are possible in light of the above teachings. It is therefore understood that within the scope of the appended claims, the present invention may be practiced other than as specifically described herein.

What is claimed:

1. A cleaning device configured for use in an image forming apparatus and configured to remove residual attachments including toner from a surface of a movable intermediate transfer element onto which toner images are transferred from at least one image carrier, the cleaning device comprising:

a cleaning brush configured to contact the surface of the intermediate transfer element and to apply a bias having a predetermined polarity to the toner adhered onto the surface of the intermediate transfer element so as to make uniform a polarity of the toner; and a pressing member configured to contact the surface of the intermediate transfer element with a predetermined pressure applied via a planar surface substantially in parallel with the intermediate transfer element, the pressing member being disposed at a position upstream of the cleaning brush in a direction of movement of the intermediate transfer element.

2. The cleaning device according to claim 1, wherein the pressing member is formed from a blade member, and the blade member contacts the surface of the intermediate transfer element such that an area of a surface of the blade member contacts the surface of the intermediate transfer element with a predetermined contact width, said surface of the blade member extending from a leading edge of the blade member located on a forward side in the direction of movement of the intermediate transfer element.

3. The cleaning device according to claim 1, wherein the pressing member is configured to contact and separate from the surface of the intermediate transfer element in a period other than at least an image forming period of the image forming apparatus.

4. The cleaning device according to claim 3, wherein the pressing member is configured to contact and separate from the surface of the intermediate transfer element in a period in which the intermediate transfer element does not carry a toner image transferred from the at least one image carrier.

5. The cleaning device according to claim 1, wherein the residual attachments further comprise paper powders, and the cleaning brush is configured to scrape the paper powders off the surface of the intermediate transfer element after the paper powders pass through a contact part between the pressing member and the surface of the intermediate transfer element.

6. An image forming apparatus, comprising:

at least one image carrier configured to carry a toner image on a surface of the at least one image carrier;

an intermediate transfer element configured to move and to receive the toner image from the surface of the at least one image carrier;

a transfer device configured to transfer the toner image from the intermediate transfer element to a transfer material; and a cleaning device used for removing residual attachments including toner from a surface of the intermediate transfer element, the cleaning device comprising:

a cleaning brush configured to contact the surface of the intermediate transfer element and to apply a bias having a predetermined polarity to the toner adhered onto the surface of the intermediate transfer element so as to make uniform a polarity of the toner; and a pressing member configured to contact the surface of the intermediate transfer element with a predetermined pressure applied via a planar surface substantially in parallel with the intermediate transfer element, the pressing member being disposed at a position upstream of the cleaning brush in a direction of movement of the intermediate transfer element.

7. The image forming apparatus according to claim 6, wherein the pressing member is formed from a blade member, and the blade member contacts the surface of the intermediate transfer element such that an area of a surface of the blade member contacts the surface of the intermediate transfer element with a predetermined contact width, said surface of the blade member extending from a leading edge of the blade member located on a forward side in the direction of movement of the intermediate transfer element.

8. The image forming apparatus according to claim 6, wherein the pressing member is configured to contact and separate from the surface of the intermediate transfer element in a period other than at least an image forming period of the image forming apparatus.

9. The image forming apparatus according to claim 8, wherein the pressing member is configured to contact and separate from the surface of the intermediate transfer element in a period in which the intermediate transfer element does not carry a toner image received from the at least one image carrier.

10. The image forming apparatus according to claim 6, wherein the residual attachments further comprise paper powders, and the cleaning brush is configured to scrape the paper powders off the surface of the intermediate transfer element after the paper powders pass through a contact part between the pressing member and the surface of the intermediate transfer element.

11. A method of removing residual attachments including toner from a surface of an intermediate transfer element, comprising:

contacting a pressing member to the surface of the intermediate transfer element with a predetermined pressure applied via a planar surface substantially in parallel with the intermediate transfer element;

moving the surface of the intermediate transfer element;

passing the residual attachments through a contact part between the pressing member and the surface of the intermediate transfer element;

applying a bias having a predetermined polarity to the toner adhered on the surface of the intermediate transfer element; and transferring the toner having the predetermined polarity from the surface of the intermediate transfer element to at least one image carrier by applying a transfer bias having a polarity equal to the predetermined polarity of the toner to the toner.

12. The method according to claim 11, wherein the contacting comprises:

contacting the pressing member to the surface of the intermediate transfer element such that an area of a surface of the pressing member contacts the surface of the intermediate transfer element with a predetermined contact width, said surface of the pressing member extending from a leading edge of the pressing member located on a forward side in the direction of movement of the intermediate transfer element.

13. The method according to claim 11, further comprising:

contacting and separating the pressing member to and from the surface of the intermediate transfer element in a period other than at least an image forming period.

14. The method according to claim 13, further comprising:

contacting and separating the pressing member to and from the surface of the intermediate transfer element in a period in which the intermediate transfer element does not carry a toner image transferred from the at least one image carrier.

15. The method according to claim 11, wherein the residual attachments further include paper powders, and the method further comprises:

separating the paper powders from the surface of the intermediate transfer element while passing the paper powders through the contact part between the pressing member and the surface of the intermediate transfer element; and scraping the paper powders off the surface of the intermediate transfer element.

16. A cleaning device configured for use in an image forming apparatus and configured to remove residual attachments including toner from a surface of a movable intermediate transfer element onto which toner images are transferred from at least one image carrier, the cleaning device comprising:

means for applying a bias having a predetermined polarity to the toner adhered onto the surface of the intermediate transfer element to uniform a polarity of the toner; and means for contacting the surface of the intermediate transfer element with a predetermined pressure applied via a planar surface substantially in parallel with the intermediate transfer element, the means for contacting being disposed at a position upstream of the means for applying in a direction of movement of the intermediate transfer element.

17. The cleaning device according to claim 16, wherein the means for contacting is configured to contact the surface of the intermediate transfer element such that an area of a surface of the means for contacting contacts the surface of the intermediate transfer element with a predetermined contact width, said surface of said means for contacting extending from a leading edge of the means for contacting located on a forward side in the direction of movement of the intermediate transfer element.

18. The cleaning device according to claim 16, wherein the means for contacting contacts and separates from the surface of the intermediate transfer element in a period other than at least an image forming period of the image forming apparatus.

19. The cleaning device according to claim 18, wherein the means for contacting contacts and separates from the surface of the intermediate transfer element in a period in which the intermediate transfer element does not carry a toner image transferred from the at least one image carrier.

20. The cleaning device according to claim 16, wherein the residual attachments further comprise paper powders, and the means for applying is configured to scrape the paper powders off the surface of the intermediate transfer element after the paper powders pass through a contact part between the means for contacting and the surface of the intermediate transfer element.

21. An image forming apparatus, comprising:

means for carrying a toner image on a surface of the means for carrying;

means for receiving the toner image from the surface of the means for carrying while moving;

means for transferring the toner image from the means for receiving to a transfer material; and a cleaning device configured to remove residual attachments including toner from a surface of the means for receiving, the cleaning device comprising:

means for applying a bias having a predetermined polarity to the toner adhered onto the surface of the means for receiving to uniform a polarity of the toner; and means for contacting the surface of the means for receiving with a predetermined pressure applied via a planar surface substantially in parallel with the means for receiving, the means for contacting being disposed at a position upstream of the means for applying in a direction of movement of the means for receiving.

22. The image forming apparatus according to claim 21, wherein the means for contacting contacts the surface of the means for receiving such that an area of a surface of the means for contacting contacts the surface of the means for receiving with a predetermined contact width, said surface of said means for contacting extending from a leading edge of the means for contacting located on a forward side in the direction of movement of the means for receiving.

23. The image forming apparatus according to claim 21, wherein the means for contacting contacts and separates from the surface of the means for receiving in a period other than at least an image forming period of the image forming apparatus.

24. The image forming apparatus according to claim 23, wherein the means for contacting contacts and separates from the surface of the means for receiving in a period in which the means for receiving does not carry a toner image received from the means for carrying.

25. The image forming apparatus according to claim 21, wherein the residual attachments further comprise paper powders, and the means for applying scrapes the paper powders off the surface of the means for receiving after the paper powders pass through a contact part between the means for contacting and the surface of the means for receiving.

* * * * *